US012139868B2

(12) United States Patent
Cheng et al.

(10) Patent No.: US 12,139,868 B2
(45) Date of Patent: Nov. 12, 2024

(54) NUCLEAR ISLAND BASE SLAB OF NUCLEAR POWER PLANT, MANUFACTURING METHOD THEREFOR, AND NUCLEAR ISLAND OF NUCLEAR POWER PLANT

(71) Applicant: Shanghai Nuclear Engineering Research & Design Institute Co., LTD., Shanghai (CN)

(72) Inventors: Shujian Cheng, Shanghai (CN); Mingguang Zheng, Shanghai (CN); Boyu Han, Shanghai (CN); Honghui Ge, Shanghai (CN); Qiang Liu, Shanghai (CN)

(73) Assignee: Shanghai Nuclear Engineering Research & Design Institute Co., LTD., Shanghai (CN)

( * ) Notice: Subject to any disclaimer, the term of this patent is extended or adjusted under 35 U.S.C. 154(b) by 4 days.

(21) Appl. No.: 18/040,511

(22) PCT Filed: Aug. 4, 2021

(86) PCT No.: PCT/CN2021/110481
§ 371 (c)(1),
(2) Date: Feb. 3, 2023

(87) PCT Pub. No.: WO2022/028451
PCT Pub. Date: Feb. 10, 2022

(65) Prior Publication Data

US 2023/0287645 A1 Sep. 14, 2023

(30) Foreign Application Priority Data

Aug. 6, 2020 (CN) ..... 202010783395.2

(51) Int. Cl.
*E02D 27/00* (2006.01)
*E02D 15/02* (2006.01)
(Continued)

(52) U.S. Cl.
CPC ..... *E02D 15/02* (2013.01); *E21F 1/04* (2013.01); *E02D 27/00* (2013.01); *E02D 2300/002* (2013.01); *E04G 21/02* (2013.01)

(58) Field of Classification Search
CPC ..... E02D 27/00; E02D 15/02; E04G 21/02; B28B 7/42; E21F 1/04
See application file for complete search history.

(56) References Cited

U.S. PATENT DOCUMENTS 5,121,789 A * 6/1992 Scharfe ..... F24D 11/007 126/400

FOREIGN PATENT DOCUMENTS

CN 203230453 U 10/2013
CN 106759359 A 5/2017
(Continued)

OTHER PUBLICATIONS

CN 108071173A (Year: 2018).*
(Continued)

*Primary Examiner* — Sunil Singh
(74) *Attorney, Agent, or Firm* — Renner, Otto, Boisselle & Sklar, LLP

(57) ABSTRACT

A nuclear island base slab of a nuclear power plant and a manufacturing method therefor, and a nuclear island of a nuclear power plant. The nuclear island base slab of a nuclear power plant includes a concrete base slab body and a plurality of air ducts embedded in the concrete base slab body. The air duct has an internal-penetrating bent pipe structure. A first end of the air duct is exposed on an upper surface of the concrete base slab body. A second end of the
(Continued)

air duct is exposed on a side surface or the upper surface of the concrete base slab body.

12 Claims, 2 Drawing Sheets

(51) Int. Cl.
*E04G 21/02* (2006.01)
*E21F 1/04* (2006.01)

(56) References Cited

FOREIGN PATENT DOCUMENTS

| | | | |
|---|---|---|---|
| CN | 108071173 | A | 5/2018 |
| CN | 207672572 | U | 7/2018 |
| CN | 109778860 | A | 5/2019 |
| CN | 111827290 | A | 10/2020 |
| CN | 213448482 | U | 6/2021 |
| JP | H01271580 | A | 10/1989 |
| KR | 20030013088 | A | 2/2003 |
| KR | 20060098407 | A | 9/2006 |
| KR | 20110127399 | A | 11/2011 |
| KR | 20120064382 | A | 6/2012 |

OTHER PUBLICATIONS

JP 4-310895 A (Year: 1992).*
KR 2003-0013088 A (Year: 2003).*
CN 102758534 A (Year: 2012).*
International Search Report for the corresponding Application No. PCT/CN2021/110481, mailed on Nov. 3, 2021.
Chinese Office Action for corresponding Application No. CN2020107833952, issued Aug. 19, 2024, with English translation.

* cited by examiner

NUCLEAR ISLAND BASE SLAB OF NUCLEAR POWER PLANT, MANUFACTURING METHOD THEREFOR, AND NUCLEAR ISLAND OF NUCLEAR POWER PLANT

CROSS-REFERENCE TO RELATED APPLICATIONS

This application is a national phase of International Application No. PCT/CN2021/110481 filed Aug. 4, 2021, which claims the priority of the Chinese patent application No. 202010783395.2, filed on Aug. 6, 2020, the entire contents of which are hereby incorporated herein by reference.

TECHNICAL FIELD

The present application relates to the field of nuclear power plant construction, and in particular to a nuclear island base slab of a nuclear power plant.

BACKGROUND

A nuclear island base slab for factory building of a nuclear power plant is mass concrete and needs longer curing duration after concrete pour. The heat of hydration generated during the pouring and curing of mass concrete increases its internal temperature. Under certain constraints, the temperature stress generated by the temperature difference between the inside and outside of the concrete causes cracks to appear on the surface thereof. Severe cracks have a very adverse effect on the construction quality, strength and durability of mass concrete structures. Especially for a concrete a nuclear island base slab of a nuclear power plant, it also has the function of shielding radiation and preventing nuclear leakage while undertaking structural functions. Therefore, it is of great significance to control early crack in pouring and curing processes of the concrete of nuclear island base slab of a nuclear power plants.

The traditional cooling technology using active cooling water coil has been more mature in the application of the mass concrete curing of civil projects, such as existing mass concrete cooling water pipe arrangement method proposed in conjunction with actual measurement or temperature field numerical simulation technology. However, these methods all rely on external auxiliary measures and driving equipment, such as refrigerators, and there are hidden risks such as pipeline leakage, corrosion, and insufficient sealing. Once problems occur, it will affect the strength of concrete and increase the risk of radioactive material leakage. Therefore, it has not been applied to nuclear power projects.

In recent years, active air-cooled technology has been applied to control the temperature of mass concrete, but this type of technology also relies on external auxiliary measures and driving equipment, such as refrigerators, fans, etc., which have high cost of use and high difficulty in implementation, and there is also the problem of grouting compactness.

SUMMARY

In order to solve the above problems, the present application provides a nuclear island base slab of a nuclear power plant. By adopting a post-grouting sunken air duct and utilizing natural convection circulation, the nuclear island base slab does not need active auxiliary facilities, and has lower construction difficulty and cost, thus reducing the risk caused by cracks in the nuclear island base slab and avoiding the occurrence of nuclear leakage accidents.

In one aspect, the present application provides a nuclear island base slab of a nuclear power plant, including a concrete base slab body and a plurality of air ducts embedded inside the concrete base slab body, wherein the air duct has an internal-penetrating bent pipe structure, a first end of the air duct is exposed on an upper surface of the concrete base slab body, and a second end of the air duct is exposed on a side surface or the upper surface of the concrete base slab body.

Preferably, the air duct includes a plurality of first air ducts and a plurality of second air ducts, a first end of the first air duct is exposed on the upper surface of the concrete base slab body, a second end of the first air duct is exposed on a first side surface of the concrete base slab body; and a first end of the second air duct is exposed on the upper surface of the concrete base slab body, and a second end of the second air duct is exposed on a second side surface opposite to the first side surface of the concrete base slab body.

Preferably, on the same horizontal plane, the plurality of first air ducts are arranged at intervals along the first side surface, and the plurality of second air ducts are arranged at intervals along the second side surface.

Preferably, an interval between two adjacent first air ducts is 50% of a thickness of the concrete base slab body, and an interval between two adjacent second air ducts is 50% of the thickness of the concrete base slab body.

Preferably, adjacent first air duct and second air duct intersect and abut against each other at an intersection position.

Preferably, after the adjacent first air duct and second air duct intersect, a distance between the first end of the first air duct and the first end of the second air duct is in a range of 3 to 5 m.

Preferably, the air duct further includes a plurality of third air ducts, a first end of the third air duct is exposed on the upper surface of the concrete base slab body and is adjacent to the first end of the first air duct, and a second end of the third air duct is exposed on the upper surface of the concrete base slab body and is adjacent to the first end of the second air duct.

Preferably, projections of the first air duct, the second air duct and the third air duct in a thickness direction of the concrete base slab body are located in a straight line, the first end of the third air duct abuts against the first end of the first air duct, and the second end of the third air duct abuts against the first end of the second air duct.

Preferably, the third air duct intersects with the first air duct and the second air duct respectively, and abuts against the first air duct and the second air duct at intersection positions, respectively.

Preferably, in a thickness direction of the concrete base slab body, heights of the second end of the first air duct and the second end of the second air duct exposed on the side surface of the concrete base slab body is 50% of a thickness of the concrete base slab body.

Preferably, the air duct is filled with mortar.

In a second aspect, the present application provides a manufacturing method for a nuclear island base slab of a nuclear power plant, including the following steps: preparing a cushion layer of the base slab, and providing a steel-bar support frame on the cushion layer; fixing a plurality of air ducts on the steel-bar support frame; forming a concrete base slab body by pouring concrete on the steel-bar support frame, so that first ends of the plurality of air ducts are exposed on an upper surface of the concrete base slab body, and second ends of the plurality of air ducts are exposed on a side surface or the upper surface of the concrete base slab body; curing the concrete base slab body; and filling mortar into the plurality of air ducts.

In a third aspect, the present application provides a nuclear island of a nuclear power plant, which includes the nuclear island base slab of a nuclear power plant as described above, or includes a nuclear island of a nuclear power plant manufactured by the manufacturing method for a nuclear island base slab of a nuclear power plant as described above.

In the nuclear island base slab of a nuclear power plant provided by the present application, by embedding the air duct inside the concrete base slab body, during the pouring and curing of the concrete base slab body, the heat in the concrete base slab body in a nuclear island will be taken away by the natural convection inside the air duct, so as to rate up the internal heat dissipation of the concrete and reduce the temperature difference between outer surfaces and the interior of the concrete, thereby shortening the curing time of the concrete and reducing the possibility of serious cracks on a surface of the concrete. After the curing of the concrete is completed, the air duct is grouted densely by using the grouting technology, wherein the air duct is easy to be grouted densely due to the existence of a sunken height.

It should be understood that the above general description and the following detailed description are exemplary only and do not limit the present application.

BRIEF DESCRIPTION OF THE DRAWINGS

In order to illustrate the technical scheme of embodiments of the present application more clearly, the accompanying drawing that needs to be used in embodiments of the present application will be briefly introduced below. Obviously, the accompanying drawing described below is only specific embodiments of the present application, those skilled in the art can obtain other embodiments according to the following figures without creative efforts.

REFERENCE NUMBERS

Figure 1:
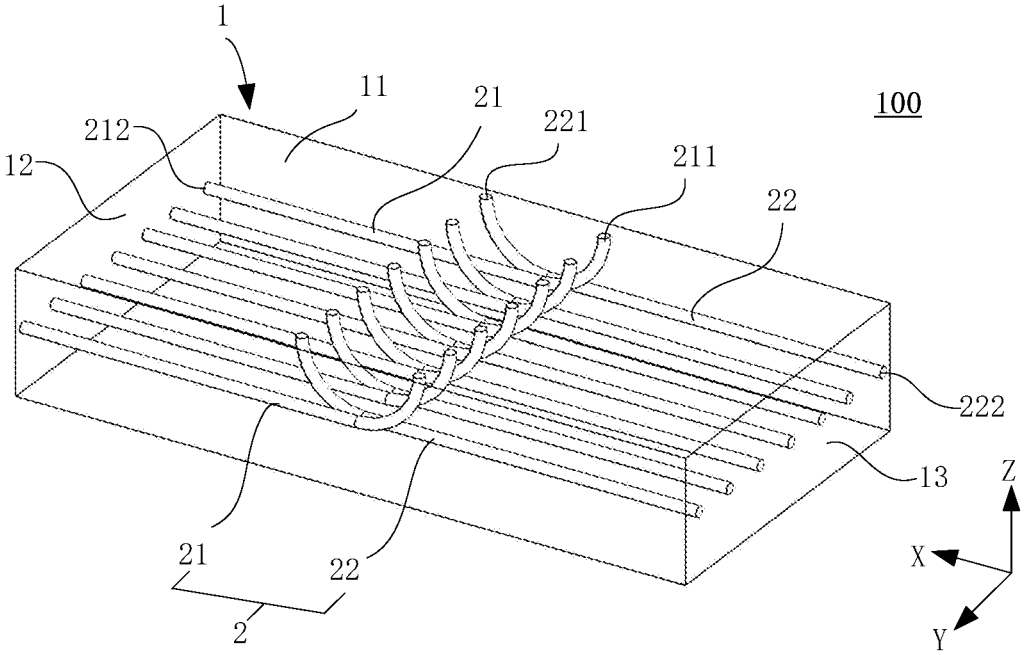
FIG. 1 is a structural perspective view of a nuclear island base slab of a nuclear power plant according to a specific embodiment of the present application.

100—Nuclear island base slab of a nuclear power plant;
1—Concrete base slab body;
11—Upper surface;
12—First side surface;
13—Second side surface;
2—Air duct;
21—First air duct;
211—First end of the first air duct;
212—Second end of the first air duct;
22—Second air duct;
221—First end of the second air duct;
222—Second end of the second air duct;
23—Third air duct;
231—First end of the third air duct;
232—Second end of third air duct.

The accompanying drawings, which are incorporated in and constitute a part of this specification, illustrate embodiments consistent with the present application and together with the description serve to explain the principles of the present application.

DETAILED DESCRIPTION

In order to better understand the technical solutions of the present application, the embodiments of the present application will be described in detail below in conjunction with the accompanying drawings.

It should be clear that the described embodiments are only some of the embodiments of the present application, rather than all of them. Based on the embodiments in the present application, all other embodiments obtained by a person skilled in the art without creative efforts fall within the protection scope of the present application.

The terms used in the embodiments of the present application are only for the purpose of describing specific embodiments, and are not intended to limit the present application. The singular forms "a", "said" and "the" used in the embodiments of the present application and the appended claims are also intended to include plural forms unless the context clearly indicates otherwise.

It should be understood that the term "and/or" used herein is only a kind of associative relationship describing associated objects, which means that there can be three kinds of relationships, for example, A and/or B can represent three cases as follows: there is A alone; there are A and B at the same time; and there is B alone. In addition, the character "/" in this description generally indicates that the associated objects before and after the character "/" are in an "or" relationship.

It should be noted that the orientation words such as "up", "down", "left" and "right" described in the embodiments of the present application are described with the view angle shown in the accompanying drawings, and should not be understood as limitations on the embodiments of the present application. Furthermore, in this context, it also needs to be understood that when it is mentioned that an element is connected "on" or "under" another element, it can not only be directly connected "on" or "under" another element, but can also indirectly connected "on" or "under" another element through an intervening element.

A nuclear island base slab for factory building belongs to mass concrete, and requires a long curing time after the pouring is completed. Shortening the curing cycle of the base slab concrete has positive significance for the entire construction cycle of a nuclear power plant.

The concrete base slab body of the following embodiments of the present application has a reinforced concrete structure. In order to clearly show an internal structure of the concrete base slab body, the concrete base slab body is transparently shown, FIG. 1 is a structural perspective view of a base slab 100 of a nuclear island of a nuclear power plant accordingly to a specific embodiment of the present application.

As shown in FIG. 1, the nuclear island base slab 100 of a nuclear power plant according to the present application includes a concrete base slab body 1 and a plurality of air ducts 2 embedded inside the concrete base slab body 1, wherein the air duct 2 has an internal-penetrating bent pipe structure, one end (first end) of the air duct 2 is exposed on an upper surface 11 of the concrete base slab body 1, and another end (second end) of the air duct 2 is exposed on a first side surface 12 or a second side surface 13.

The concrete base slab body 1 may have the conventional reinforced concrete structure of a nuclear power plant. When preparing the concrete base slab body 1, a cushion layer of the base slab is prepared first in the field, and then a steel-bar support frame (not shown in the figure) is prepared on the cushion layer. The air ducts 2 can be tied and fixed on the steel-bar support frame before pouring concrete on the steel-bar support frame. In the pouring, attention should be paid to exposing both ends of the air ducts 2 so as to form the concrete base slab body 1.

The air ducts 2 can be implemented by a corrugated steel pipe for a prestressed containment, with a diameter of 100 mm to 200 mm. The corrugated steel pipe for a prestressed containment is a non-structural component, and is only used as air ducts of passive air-cooling passages for passive air-cooling.

The heat of hydration generated during the pouring and curing of mass concrete will increase its internal temperature. Under certain constraints, the temperature stress generated by the temperature difference between the inside and outside of the concrete will cause cracks to appear on the surface thereof. Severe cracks have a very adverse effect on the construction quality, strength and durability of mass concrete structures. Especially for the concrete nuclear island base slab of a nuclear power plant, it also has the function of shielding radiation and preventing nuclear leakage while undertaking structural functions.

In the present application, by pre-embedding the air ducts 2 inside the concrete base slab body 1, during pouring and curing of the concrete base slab body, as the heat inside the concrete base slab body 1 becomes higher, hot air constantly rises through the air ducts 2 and is brought into the atmosphere via the first end of the air ducts 2 exposed on the upper surface 11 of the concrete base slab body 1, while air with a lower temperature enters the air ducts 2 via the second end thereof to form convection with the hot air, so as to take away the heat in the concrete base slab body 1, accelerate the heat dissipation rate of the concrete base slab body 1, and reduce the temperature difference between the outer surface and the interior of the concrete base slab body 1, thereby shortening the curing time of the concrete and reducing the possibility of serious cracks on a surface of the concrete.

The nuclear island base slab 100 of a nuclear power plant provided by the present application utilizes the natural convection inside the air ducts 2 to take away the heat in the concrete base slab body 1, which belongs to passive technology. Compared with the traditional air-cooling and water-cooling technology, it does not rely on external auxiliary measures and driving equipment such as refrigerators, fans, heat exchangers, etc., has a low use cost and does not cause waste of resources.

As shown in FIG. 1, in a specific embodiment, the air ducts 2 include a plurality of first air ducts 21 and a plurality of second air ducts 22. A first end 211 of the first air duct 21 is exposed on the upper surface 11 of the concrete base slab body 1, and a second end 212 of the first air duct 21 is exposed on the first side surface 12 of the concrete base slab body 1; and a first end 221 of the second air duct 22 is exposed on the upper surface 11 of the concrete base slab body 1, and a second end 222 of the second air duct 22 is exposed on the second side surface 13 opposite to the first side surface 12 of the concrete base slab body 1.

The first end 211 of the first air duct 21 and the first end 221 of the second air duct 22 are respectively exposed on the upper surface 11 of the concrete base slab body 1, and the second end 212 of the first air duct 21 and the second end 222 of the second air duct 22 are respectively exposed on the first side surface 12 and the second side surface 13 which are opposite to each other, so that positions of the second end 212 of the first air duct 21 and the second end 222 of the second air duct 22 are lower than positions of the first end 211 of the first air duct 21 and the first end 221 of the second air duct 22. In this way, the hot air rises constantly through the air duct 2 and flow out via the first end 211 of the first air duct 21 and the first end 221 of the second air duct 22 exposed on the upper surface 11 of the concrete base slab body 1 to bring the heat into the atmosphere, while the air with a lower temperature enters via the second end 212 of the first air duct 21 and the second end 222 of the second air duct 22 at lower positions, which makes it easier to form convection and accelerate the heat dissipation rate inside the concrete base slab body 1.

In a specific embodiment, on the same horizontal plane, a plurality of first air ducts 21 are arranged at intervals along the first side surface 12, and a plurality of second air ducts 22 are arranged at intervals along the second side surface 13.

A plurality of first air ducts 21 and a plurality of second air ducts 22 are arranged at intervals to cover the width of the concrete base slab body 1 in a width direction Y of the concrete base slab body 1, and the second end 212 of the first air duct 21 and the second end 222 of the second air duct 22 are respectively exposed from the opposite first side surface 12 and the second side surface 13, that is, the first air ducts 21 and the second air ducts 22 are arranged along a length direction X of the concrete base slab body 1, so that the air ducts 2 can cover the whole concrete base slab body 1 as much as possible, and the overall heat dissipation rate of the concrete base slab body 1 can be accelerated.

Further, an interval between two adjacent first air ducts 21 is 50% of the thickness of the concrete base slab body, and an interval between two adjacent second air ducts 22 is 50% of the thickness of the concrete base slab body, so that the heat dissipation rate of the concrete base slab body 1 is distributed more uniform and the possibility of cracks is reduced.

In a specific embodiment, adjacent first air duct 21 and second air duct 22 intersect and abut against each other at an intersection position. The arrangement that adjacent first air duct 21 and second air duct 22 intersect means that, in the length direction X of the concrete base slab body 1, the sum of the projection lengths of the first air duct 21 and the second air duct 22 in a thickness direction Z of the concrete base slab body 1 is greater than the length of the concrete base slab body 1, so that the first air ducts 21 and the second air ducts 22 can cover the length of the concrete base slab body 1 and the overall heat dissipation rate of the concrete base slab body 1 is accelerated.

Further, after the adjacent first air duct 21 and second air duct 22 intersect, a distance between the first end 211 of the first air duct 21 and the first end 221 of the second air duct 22 is in a range of 3 m to 5 m. By an arrangement that the first air duct 21 and the second air duct 22 overlap alternatively for a certain distance along the length direction X, the internal heat dissipation rate of the concrete base slab body 1 can be accelerated.

For the concrete base slab body 1 of a large area, since the length of its length direction X is longer, providing the first air ducts 21 and the second air ducts 22 only will make the length of the air duct 2 in the length direction X to be too long, which is not conducive to heat dissipation; and when the air duct 2 is filled with mortar, it is easy to leave gaps in the air duct 2, so that it is not easy to fill it densely, which increases the risk of radioactive material leakage.

Figure 2:
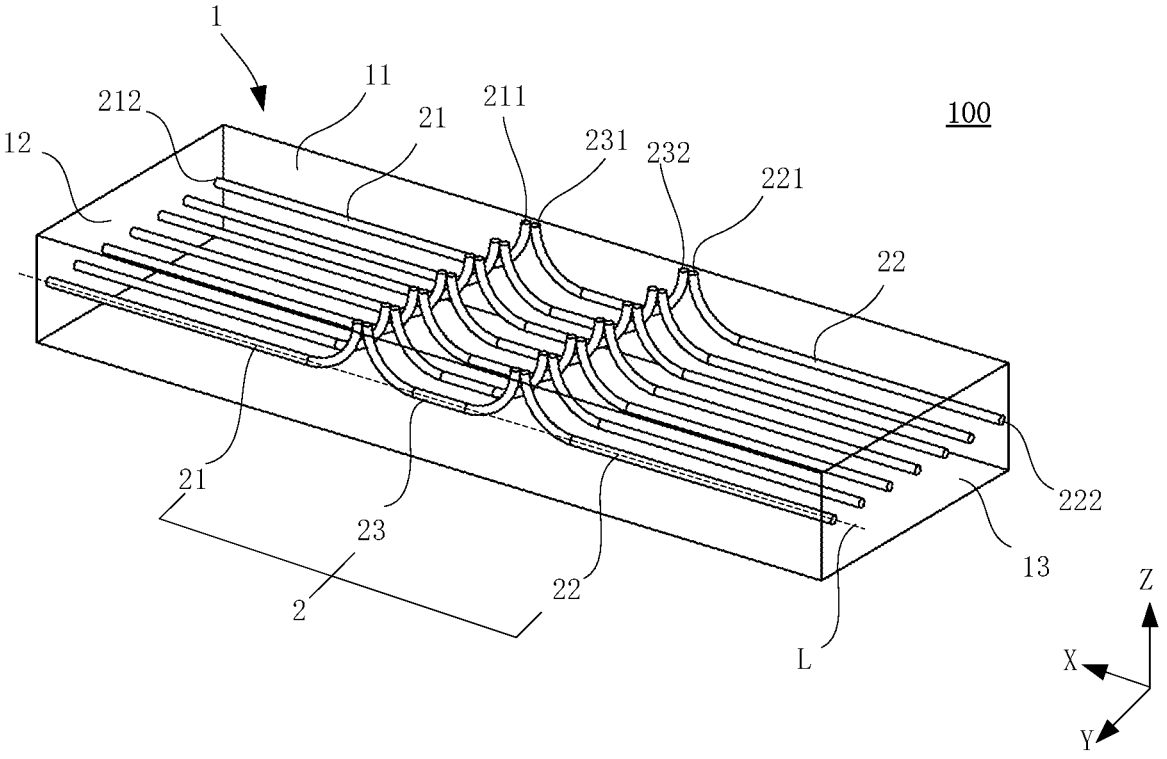
FIG. 2 is a structural perspective view of a nuclear island base slab of a nuclear power plant according to another specific embodiment of the present application.

FIG. 2 is a structural perspective view of a nuclear island base slab 100 of a nuclear power plant according to another specific embodiment of the present application.

In order to solve the above-mentioned problems that it is not easy for the long concrete base slab body 1 to dissipate heat and that it is difficult to fill the air duct 2 densely, in another embodiment, the air duct 2 further includes a plurality of third air ducts 23, a first end 231 of the third air duct 23 is exposed on the upper surface 11 of the concrete base slab body 1 and is adjacent to the first air duct 21, and a second end 232 of the third air duct 23 is exposed on the upper surface 11 of the concrete base slab body 1 and is adjacent to the second air duct 22.

The arrangement of embedding the third air duct 23 adjacent to the first air duct 21 and the second air duct 22 respectively in the concrete base slab body 1 so that the first end 231 and the second end 232 of the third air duct 23 are respectively exposed from the upper surface 11 of the concrete base slab body 1, can make the lengths of the first air duct 21 and the second air duct 22 in the length direction X to be smaller, thereby making it easier to fill the respective air ducts 2 densely when filling them with mortar.

As shown in FIG. 2, in a specific embodiment, projections of the first air duct 21, the second air duct 22 and the third air duct 23 in the thickness direction Z of the concrete base slab body 1 are located on one straight line L (dotted line in FIG. 2). The first end 231 of the third air duct 23 abuts against the first end 211 of the first air duct 21, and the second end 232 of the third air duct 23 abuts against the first end 221 of the second air duct 22.

In a specific embodiment, in the length direction X of the concrete base slab body 1, the sum of projection lengths of the third air duct 23, the first air duct 21 and the second air duct 22 in the thickness direction Z of the concrete base slab body 1 is equal to the length of the concrete base slab body 1, so that there is no range that the air duct 2 cannot cover in the length direction X of the concrete base slab body 1, that is, the first air duct 21, the second air duct 22 and the third air duct 23 can cover the entire length of the concrete base slab body 1, which is conducive to uniform heat conduction and can accelerate the overall heat dissipation rate of the concrete base slab body 1.

In order to adapt to more size ranges of the concrete base slab body 1, the present application is not limited to a case in which only one third air duct 23 is arranged in the length direction X of the concrete base slab body 1. According to an actual length of the concrete base slab body 1, a plurality of third air ducts 23 can be provided in an arrangement in which ends of two adjacent third air ducts 23 abut against each other, and the third air ducts 23 at both ends abut against the first air duct 21 and the second air duct 22 respectively, so as to be applicable-more usage scenarios.

Figure 3:
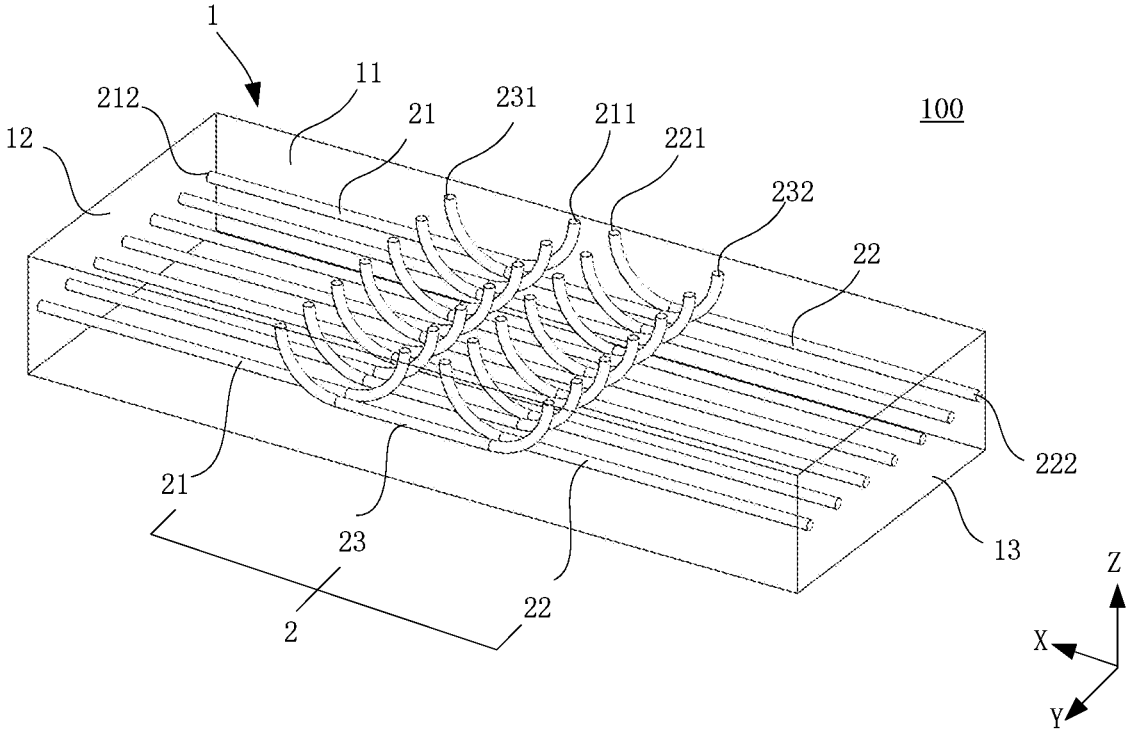
FIG. 3 is a structural perspective view of a nuclear island base slab of a nuclear power plant according to yet another specific embodiment of the present application.

FIG. 3 is a structural perspective view of a nuclear island base slab of a nuclear power plant according to yet another specific embodiment of the present application.

In a specific embodiment, the third air duct 23 intersects with the first air duct 21 and the second air duct 22 respectively, and abuts against the first air duct 21 and the second air duct 22 at intersection positions respectively. In such arrangement that the third air duct 23 intersects with the first air duct 21 and the second air duct 22 respectively, in the length direction X of the concrete base slab body 1, a sum of projection lengths of the third air duct 23, the first air duct 21 and the second air duct 22 in the thickness direction Z of the concrete base slab body 1 is greater than the length of the concrete base slab body 1, so that the first air duct 21, the second air duct 22 and the third air duct 23 can cover the entire length of the concrete base slab body 1, thereby accelerating the overall heat dissipation rate of the concrete base slab body 1. Similarly, a plurality of third air ducts 23 can also be arranged in the length direction X, so as to be applicable to more usage scenarios.

Further, in the thickness direction Z of the concrete base slab body, heights of the second end 212 of the first air duct 21 and the second end 222 of the second air duct 22 exposed on the side surface of the concrete base slab body 1 is 50% of a thickness of the concrete base slab body 1. In this way, the heat dissipation rate of the concrete base slab body 1 is distributed more uniform and the possibility of cracks is reduced.

During the curing of the concrete base slab body 1 after pouring, the air duct 2 can accelerate the heat dissipation inside the concrete base slab body 1, and the rapid curing of the concrete base slab body 1 can be realized.

After the concrete base slab body 1 is cured, grouting is carried out inside the air duct 2, so that the air duct 2 is filled with mortar. The filling of mortar can be implemented by the prestressed containment grouting technology. In a grouting operation, the mortar is injected via the first end exposed on the upper surface 11 of the concrete base slab body 1. After the mortar flows into the air duct 2 from top to bottom, due to the existence of a sunken height, the air duct 2 is compacted, and there is no risk of radioactive material leakage.

Figure 4:
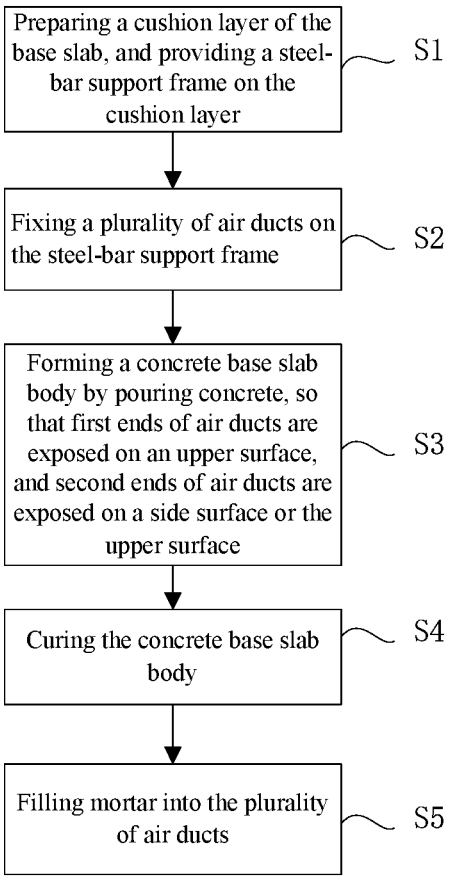
FIG. 4 is a flow chart of a manufacturing method for a nuclear island base slab of a nuclear power plant according to an embodiment of the present application.

FIG. 4 is a flow chart of a manufacturing method for a nuclear island base slab of a nuclear power plant according to an embodiment of the present application.

The present application also provides a manufacturing method for a nuclear island base slab of a nuclear power plant, which includes the following steps S1-S5.

In step S1, a cushion layer of the base slab is prepared, and a steel-bar support frame is provided on the cushion layer;

In step S2, a plurality of air ducts are fixed on the steel-bar support frame;

In step S3, the concrete base slab body is formed by pouring concrete on the steel-bar support frame, so that first ends of the plurality of air ducts are exposed on an upper surface of the concrete base slab body, and second ends of the plurality of air ducts are exposed on a side surface or the upper surface of the concrete base slab body;

In step S4, the concrete base slab body is cured;

In step S5, mortar is filled into the plurality of air ducts.

The present application also provides a nuclear island of a nuclear power plant, which includes the nuclear island base slab 100 of a nuclear power plant as described above, or has a nuclear island base slab manufactured by the manufacturing method for a nuclear island base slab of a nuclear power plant as described above.

In the nuclear island base slab of a nuclear power plant and the manufacturing method therefor as well as the nuclear island of a nuclear power plant provided by the present application, by embedding the air duct inside the concrete base slab body, during the pouring and curing of the concrete base slab body, the heat in the concrete base slab body in a nuclear island will be taken away by the natural convection inside the air duct, so as to rate up the internal heat dissipation of the concrete and reduce the temperature difference between outer surfaces and the interior of the concrete, thereby shortening the curing time of the concrete and reducing the possibility of serious cracks on a surface of the concrete. After the curing of the concrete is completed, the air duct is grouted densely by using the grouting technology, wherein the air duct is easy to be grouted densely due to the existence of a sunken height.

The above is only preferred embodiments of the present application, and is not intended to limit the present application. For those skilled in the art, the present application can have various modifications and changes. Any modifications, equivalent replacements, improvements, etc. made within the spirit and principles of the present application shall be included within the protection scope of the present application.

What is claimed is:

1. A nuclear island base slab of a nuclear power plant, comprising a concrete base slab body, and a plurality of air ducts embedded inside the concrete base slab body, wherein each of the plurality of air ducts has an internal-penetrating bent pipe structure, a first end of each of the plurality of air ducts is exposed on an upper surface of the concrete base slab body, and a second end of each of the plurality of air ducts is exposed on a first side surface, a second side surface opposite to the first side surface, or the upper surface of the concrete base slab body, wherein the plurality of air ducts comprises a plurality of first air ducts and a plurality of second air ducts, a first end of each of the plurality of first air ducts is exposed on the upper surface of the concrete base slab body, and a second end of each of the plurality of first air ducts is exposed on the first side surface of the concrete base slab body, and a first end of each of the plurality of second air ducts is exposed on the upper surface of the concrete base slab body, and a second end of each of the plurality of second air ducts is exposed on the second side surface opposite to the first side surface of the concrete base slab body.

2. The nuclear island base slab of a nuclear power plant according to claim 1, wherein on the same horizontal plane, the plurality of first air ducts are arranged at intervals along the first side surface, and the plurality of second air ducts are arranged at intervals along the second side surface.

3. The nuclear island base slab of a nuclear power plant according to claim 2, wherein an interval between two adjacent first air ducts is 50% of a thickness of the concrete base slab body, and an interval between two adjacent second air ducts is 50% of the thickness of the concrete base slab body.

4. The nuclear island base slab of a nuclear power plant according to claim 3, wherein adjacent first air duct and second air duct intersect and abut against each other at an intersection position.

5. The nuclear island base slab of a nuclear power plant according to claim 4, wherein after the adjacent first air duct and second air duct intersect, a distance between the first end of the first air duct and the first end of the second air duct is in a range of 3 m to 5 m.

6. The nuclear island base slab of a nuclear power plant according to claim 1, wherein the plurality of air ducts further comprises a plurality of third air ducts, a first end of each of the plurality of third air ducts is exposed on the upper surface of the concrete base slab body, and the first ends of the plurality of third air ducts are adjacent to respectively the first ends of the plurality of first air ducts, and a second end of each of the plurality of third air ducts is exposed on the upper surface of the concrete base slab body, and the second ends of the plurality of third air ducts are adjacent to respectively the first ends of the plurality of second air ducts.

7. The nuclear island base slab of a nuclear power plant according to claim 6, wherein projections of the first air duct, the second air duct and the third air duct in a thickness direction of the concrete base slab body are located in a straight line, the first end of the third air duct abuts against the first end of the first air duct, and the second end of the third air duct abuts against the first end of the second air duct.

8. The nuclear island base slab of a nuclear power plant according to claim 6, wherein the third air duct intersects with the first air duct and the second air duct respectively, and abuts against the first air duct and the second air duct at intersection positions respectively.

9. The nuclear island base slab of a nuclear power plant according to claim 1, wherein in a thickness direction of the concrete base slab body, heights of the second end of each of the plurality of first air ducts exposed on the first side surface of the concrete base slab body are 50% of a thickness of the concrete base slab body, and heights of the second end of each of the plurality of second air ducts exposed on the second side surface of the concrete base slab body are 50% of a thickness of the concrete base slab body.

10. The nuclear island base slab of a nuclear power plant according to claim 1, wherein the plurality of air ducts are filled with mortar.

11. A manufacturing method for a nuclear island base slab of a nuclear power plant, comprising steps of:

preparing a cushion layer of the base slab, and providing a steel-bar support frame on the cushion layer;

fixing a plurality of air ducts on the steel-bar support frame;

forming a concrete base slab body by pouring concrete on the steel-bar support frame, so that first ends of each of the plurality of air ducts are exposed on an upper surface of the concrete base slab body, and second ends of each of the plurality of air ducts are exposed on a first side surface, a second side surface opposite to the first side surface, or the upper surface of the concrete base slab body;

wherein the plurality of air ducts comprises a plurality of first air ducts and a plurality of second air ducts, a first end of each of the plurality of first air ducts is exposed on the upper surface of the concrete base slab body, and a second end of each of the plurality of first air ducts is exposed on the first side surface of the concrete base slab body, and a first end of each of the plurality of second air ducts is exposed on the upper surface of the concrete base slab body, and a second end of each of the plurality of second air ducts is exposed on the second side surface opposite to the first side surface of the concrete base slab body;

curing the concrete base slab body; and filling mortar into the plurality of air ducts.

12. A nuclear island of a nuclear power plant, comprising the nuclear island base slab of a nuclear power plant according to claim 1.

* * * * *